US006105776A

United States Patent [19]

Meilhon

[11] Patent Number: 6,105,776

[45] Date of Patent: Aug. 22, 2000

[54] PACK OF ARTICLES PACKAGED USING A PLASTIC FILM AND PROCESS FOR THE MANUFACTURE OF THE PLASTIC FILM

[75] Inventor: Daniel Meilhon, Sort-En-Chalosse, France

[73] Assignee: Soparil SA, France

[21] Appl. No.: 09/119,017

[22] Filed: Jul. 20, 1998

[51] Int. Cl.[7] ..... B65D 71/08; B65D 65/28; B65B 21/00

[52] U.S. Cl. ..... 206/497; 206/432; 229/87.05; 383/201; 428/34.9

[58] Field of Search ..... 383/201, 908; 229/87.05; 206/432, 497; 428/34.9

[56] References Cited

U.S. PATENT DOCUMENTS

| | | | |
|---|---|---|---|
| 4,333,570 | 6/1982 | Heider | 206/432 |
| 4,971,197 | 11/1990 | Worley | 206/497 X |
| 5,067,612 | 11/1991 | Tsuchiya et al. | 206/497 |
| 5,169,696 | 12/1992 | Long et al. | 383/908 X |
| 5,356,677 | 10/1994 | Meilhon et al. . | |
| 5,556,674 | 9/1996 | Meilhon . | |
| 5,630,307 | 5/1997 | Cathala . | |

FOREIGN PATENT DOCUMENTS

| | | | |
|---|---|---|---|
| 40-4311456 | 11/1992 | Japan | 383/201 |

*Primary Examiner*—Bryon P. Gehman
*Attorney, Agent, or Firm*—Millen, White, Zelano &Branigan, P.C.

[57] ABSTRACT

A pack of articles (2) packaged using a plastic material film (3) having a preferred direction of tearing (D), a plurality of articles (2) being disposed side by side in one or more superposed layers, the film being folded over along a winding direction (E) around the articles which it retains, opening means being provided on the film to facilitate the tearing thereof. The means for opening the film (3) comprise a continuous zone of weakening (A), which zone is oriented transversely to the preferred direction of tearing (D), and forming a band (6) which surrounds the pack, this zone of weakening (A) having a mechanical strength which is sufficiently high to bear the traction stresses exerted on the film to retain the articles, but sufficiently low to permit opening of the film, without a tool, at any point whatsoever of the zone.

33 Claims, 1 Drawing Sheet

PACK OF ARTICLES PACKAGED USING A PLASTIC FILM AND PROCESS FOR THE MANUFACTURE OF THE PLASTIC FILM

FIELD OF THE INVENTION

The invention relates to a pack of articles, such as cans of food, canisters, bottles, etc., packaged using a plastic material film having a preferred direction of tearing wherein, a plurality of articles is therefor disposed side by side in one or more superposed layers with the film being folded over along a winding direction around the articles which it retains and with, opening means being provided on the film to facilitate the tearing thereof.

BACKGROUND OF THE INVENTION

Such a pack is prepared in a known manner by tight packing of the group of articles. The tight packing consists in surrounding the set of articles to be packed up with a heat-shrinkable plastic material film, in particular with a heat-shrinkable polyethylene film. The envelope formed with the film is welded on the edges which overlap in such a manner as to form a sleeve around the articles grouped together. The retention of the articles may be achieved, for example, by the effect of the heat which causes the tightening of the film around the articles which it envelops. The two open ends of the sleeve shrink to form at the two ends of the pack an opening of oval shape, generally referred to as a crescent.

The opening of the pack and the removal of the articles present a problem.

It is, in fact, desired to avoid the use of a sharp-edged tool, which is not always available immediately when it is desired to remove one of the articles, and which, moreover, runs the risk of damaging the articles and/or of causing a poorly controlled tearing of the film, releasing a number of articles greater than that desired.

A solution already proposed by EP-A-0537079 consists in providing as opening means tongues, for example of rectangular shape, the major dimension of which is oriented parallel to the preferred direction of tearing, these tongues being precut along their two long sides and one short side. Such tongues are constructed by indentations of"punch" type, at positions which are spaced from one another.

While constituting an advance, this solution exhibits a plurality of disadvantages, in particular the discontinuous construction of these indentations, as well as the limitation of the choice of the opening locations which must correspond to these tongues.

The principal object of the invention is to provide a pack of articles, in which pack the means for opening the plastic material film permit an easy and controlled opening of the load constituted by the pack of articles at a number of points which is as large as possible, in such a manner as to enable the user to choose the place which is the most appropriate for forming each opening.

SUMMARY OF THE INVENTION

According to the invention, the pack of articles is defined in that the means for opening the plastic material film comprise a continuous zone of weakening, which zone is oriented transversely to the preferred direction of tearing, and forming a band which surrounds the pack, this zone of weakening having a mechanical strength which is sufficiently high to bear the traction stresses exerted on the film to retain the articles, but sufficiently low to permit opening of the film, without a tool, at any point whatsoever of the zone.

Advantageously, the continuous zone of weakening is perpendicular to the preferred direction of tearing.

Preferably, the continuous zone of weakening comprises at least one line of perforations, in particular regularly spaced.

Advantageously, the continuous zone of weakening comprises a central line of perforations which is surrounded by two parallel lines of perforations, spaced from the central line, and in which the distance between two successive perforations is greater than the distance between two successive perforations of the central line. Preferably, the distance between two successive perforations of the outer lines is equal to twice the distance between two perforations of the central line.

The perforations of the two outer lines are advantageously aligned with a perforation of the central line along a direction orthogonal to the central line. The patterns created by the perforations thus have the shape of an I.

The plastic material packaging film is preferably a two-layer film, the preferred direction of tearing of which is perpendicular to the direction of extrusion. The film is, in particular, an ionomeric coextruded polyethylene film. Such a film may be constituted by at least one layer of polyolefin and at least one layer of an ionic copolymer.

The lines of perforations may have a spacing of 5 to 30 mm, over a width of 30 to 100 mm.

The invention likewise relates to a plastic material film for the tight packing of packed articles, this film having a preferred direction of tearing and being defined by the presence of a continuous zone of weakening, which zone is oriented transversely, in particular perpendicularly, to the preferred direction of tearing.

This continuous zone of weakening comprises at least one line of regularly spaced perforations, and preferably at least three lines of perforations, that is to say a central line in which the perforations have a smaller spacing than in two outer lines which are parallel to the central line and situated on either side, the perforations of the central line and of the outer lines preferably forming I-shaped patterns.

In the case of a plastic material film the preferred direction of tearing of which is perpendicular to the direction of extrusion, a process for the preparation of the film consists in forming the perforations in the course of the unwinding or of the winding of the film before packaging, along its entire length, in particular at the time of extrusion, rewinding, printing or on the tight packaging machine, by a device constituted by needle rollers with a counterpart in the form of a cylindrical brush. The plastic material film to be perforated passes between the needle roller and its counterpart.

This operation may be repeated over the width of the film, having regard to the final use, in order to create a plurality of continuous zones of weakening which are parallel to one another, in the direction of the length of the film.

Apart from the arrangements set forth hereinabove, the invention consists in a certain number of other arrangements to which more explicit reference will be made hereinbelow in connection with a particular embodiment described with reference to the accompanying drawing, but which is no sense limiting.

DETAILED DESCRIPTIONS

Figure 1:
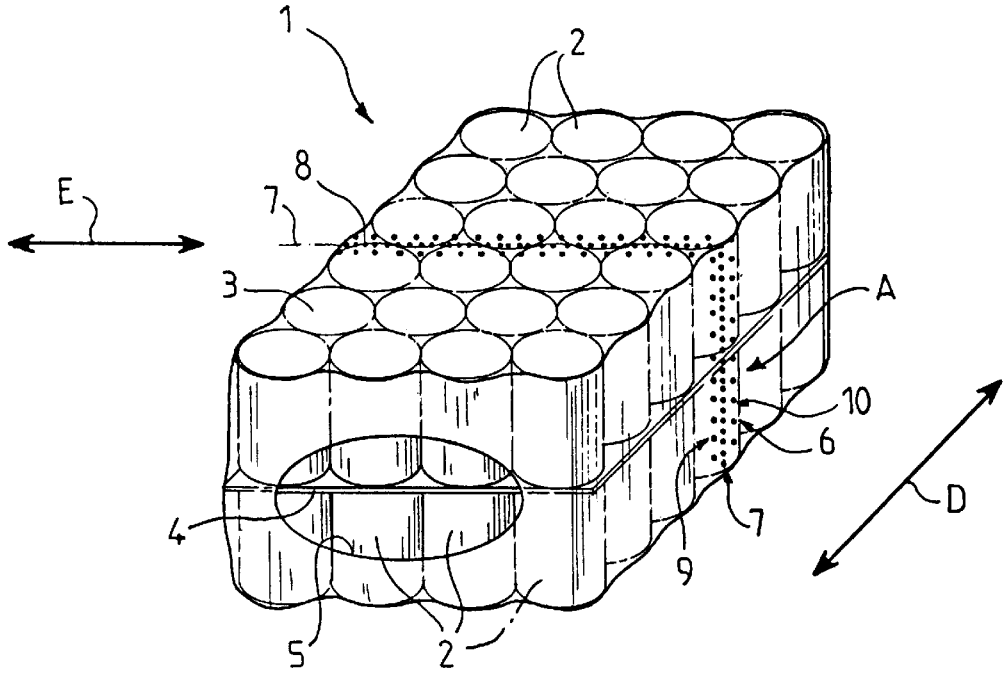
FIG. 1 of the drawing is a diagrammatic perspective view of a pack of articles according to the invention.

Referring to FIG. 1 of the drawing, a pack 1 of articles 2 comprises cans of food, canisters or the like, packaged using a plastic material film 3, which is generally transparent. A plurality of articles are disposed side by side, in two superposed horizontal layers in the example shown in FIG. 1. A board 4, in particular of cardboard, separates the two layers.

The film 3 has been folded over along a winding direction E to form a sleeve around the load constituted by the articles 2. The edges of this sleeve which are perpendicular to the direction E are welded to one another.

Generally, the arrangement of the articles forms globally a rectangular parallelepiped, the long sides of which are perpendicular to the winding direction of the film. The open ends of the sleeve formed around the package correspond to the small faces of the parallelepiped.

The film 3 is subjected to a heat treatment causing the tightening thereof around the articles 2 in such a way that the open ends of the sleeve likewise tighten to form oval openings 5, or crescents, substantially at the center of each small end face of the parallelepiped.

The film 3 exhibits a preferred direction of tearing D parallel to the long sides of the parallelepiped.

The film 3 is advantageously constituted by a film comprising at least two layers. The film is formed of at least two thermoplastic resins, and the preferred direction of tearing D of the film is substantially perpendicular to the direction of extrusion E which is the same as the winding direction. The film is, in particular, formed of at least one layer of polyolefin and at least one layer of an ionic copolymer. The film is, for example, an ionomeric coextruded polyethylene film. A film according to EP-A-0537080 is particularly suitable.

The pack 1 comprises opening means constituted by a continuous zone A of weakening of the film 3, which zone is oriented transversely, preferably perpendicularly, to the preferred direction of tearing D of the film. The zone A forms a band 6 which surrounds the pack on four faces of the parallelepiped.

In the example shown in FIG. 1, a single band 6 is provided, halfway along the large faces of the parallelepiped, that is to say halfway across the width of the film 3. Depending on the requirements, it is possible to provide a plurality of parallel bands 6, which are spaced along the width of the film 3.

The continuous zone of weakening A is thus oriented in the direction of unwinding from the drum of the film 3 and is defined by a linear array of perforations, a preferred embodiment of which is set forth in the following discussion.

The zone A comprises a central line 7 of perforations A, which are regularly spaced and aligned orthogonally to the direction D.

Two outer lines 9, 10 of perforations are situated either side of the central line 7, parallel to the latter, at equal distance, and include perforations 11*a*, 11*b*. The distance h between the lines of perforations is preferably within the range between 5 and 30 mm. The width L of the zone of weakening is preferably within the range between 30 and 100 mm. This width L corresponds to the distance between the outer edges of the perforations of the lines 9 and 10.

The distance f between two perforations 11*a* or 11*b* of the outer lines 9 and 10 is greater than the distance g of two successive perforations 8 of the central line 7. In particular, the distance f is twice the distance g (f =2 g).

The perforations 11*a*, 11*b* of the two outer lines are aligned with a perforation 8 of the central line 7 along a direction orthogonal to this central line.

Figure 2:
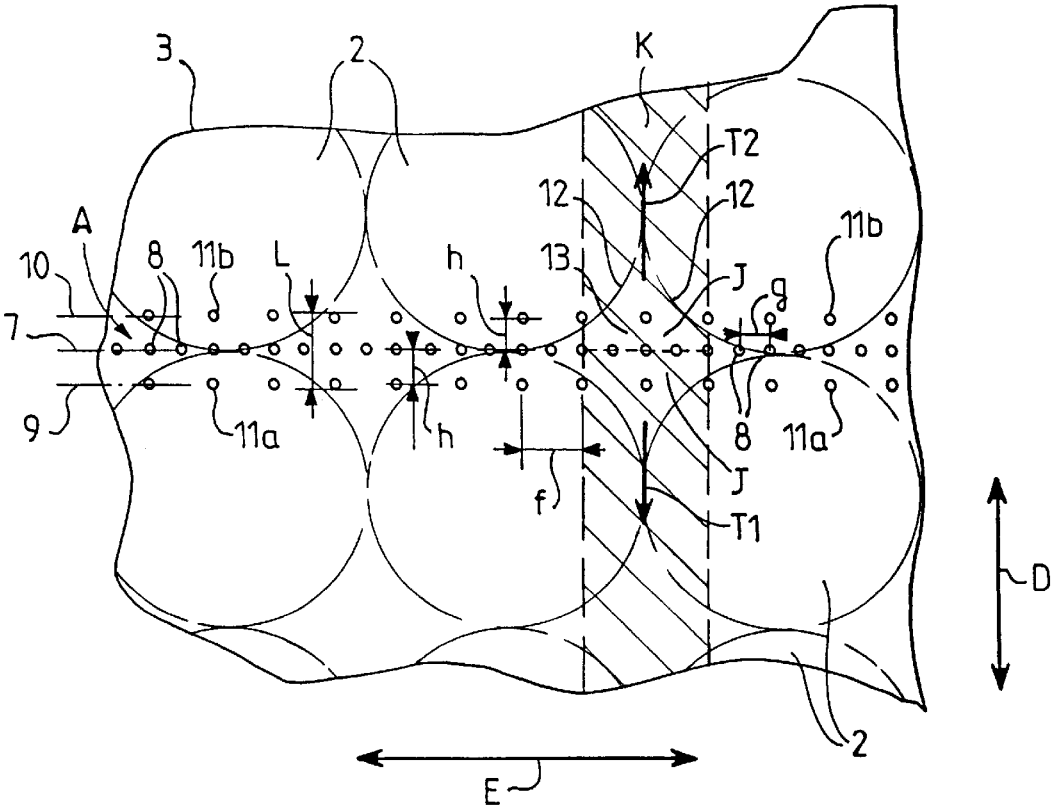
FIG. 2 finally, is a top view, on a larger scale, of a part of the pack of FIG. 1.

With f =2 g, one opening 8 in two is not surrounded by openings 11*a*, 11*b*, as can be seen in FIG. 2. The patterns created by these perforations have an I shape, reclining horizontally in FIG. 2.

The given example of three parallel lines of perforations, with a central line in which the number of perforations per unit length is double, is not limiting. It would be possible to provide on each side of the central line two or more outer lines of perforations of greater spacing.

The perforations 8, 11*a*, 11*b* may be formed in the course of the extrusion of the film 3, or indeed in the course of the rewinding thereof, or indeed at the time of printing, or indeed on the apparatus (tight packaging machine) for forming the pack.

The perforations are preferably formed by a device (not shown) constituted by hot or cold needle rollers, with a counterpart in the form of a cylindrical brush on which the film is supported. The perforation needles have a diameter of approximately 1 mm and a length of approximately 10 mm and are mounted on rotating shafts, the film to be perforated passing between the needle roller and its counterpart.

The precut constituted by the zone A is thus formed continuously.

FIG. 2 shows the circular contours 12 of cans of food of the same diameter which are mutually tangent and which define between them empty spaces 13 in the form of stars with four arms; the centers of the contours 12 are situated at the vertices of squares having a side length equal to the diameter of the contours. Preferably, the zone A covers over a succession of empty spaces 13, and the central line 7 of perforations passes substantially at the center of these empty spaces.

A combination is made of the arrangement of the articles within the pack and the distribution of the zone or zones A over the width of the film so that the zone or zones A cover(s) over a succession of empty spaces 13. Thus, in the case where the zone A is provided halfway along the width of the film, the number of articles in a row orthogonal to the direction E is an even number.

The opening of the film 3 for the purpose of removing one or more cans of food is effected in the following manner.

A pressure is exerted with a finger at a selected place or site in therefor the zone A, for example at the level of an interstice 13 formed as a space defined by gaps between the cans where the cans do not abut which are mutually tangent and tightly packed, to rupture the plastic sheet initiate a tongue J (FIG. 2)of 2 tear strip, the width of which substantially corresponds to twice the distance f between two perforations 11*a* or 11*b* of the outer lines. The edge of the tongue corresponding to the central line 7 will be cut off. It is then sufficient to grasp this edge and to pull the tongue J in the direction of the arrow T1 or T2, that is to say along the preferred direction D of tearing, perpendicularly to the lines of perforations 7, 9, 10 to effect the opening by cutting, in the film 3, of a strip K, the width of which corresponds to that of the tongue J. The traction on the tongue J is thus exerted in a direction transverse, advantageously perpendicular, to the direction of the zone of weakening A forming a band, and not in the direction of this zone A put into concrete form by the lines of perforations 7, 9, 10.

The strip K has a width which is substantially twice the spacing f between two perforations 11*a* or 11*b* and, in practice, within the range between 10 and 60 mm.

The heat-shrinkable film 3 undergoes thermal stresses in the course of contraction or shrinkage. The distance between the perforations 8, 11*a*, 11*b* and their diameter are selected as a function of the mechanical characteristics of the film 3, in order to avoid the formation of holes in the film, which holes would join together under the effect of the thermal stresses, while permitting a weakening of the zone under consideration A, which will permit the initiation of the opening tongues J.

Printing may be effected on the zone of weakening A, in particular along the lines of perforations, in order to set them into material form and to make them more visible. This printing will give indications as to the movements to be effected in order to initiate and propagate the tearing of the film 3 starting from the perforations 8, 11*a* and 11*b*.

The solution of the invention is very easy to implement, permitting the adaptation of the precut at any stage of the production/conversion/utilization of the product. This solution is complementary to the properties of the film 3 having good transverse tearing.

The invention ensures a continuous formation of the zone of weakening A, while maintaining the integrity of the heat-shrunk load as compared with a discontinuous process involving indentation of the "punch" type.

The preceding examples can be repeated with similar success by substituting the generically or specifically described reactants and/or operating conditions of this invention for those used in the preceding examples.

The entire disclosure of all applications, patents and publications, cited above and below, and of corresponding French application 97/09404, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A pack of articles, wherein the articles are one of cans of food, canisters, and bottles, the pack being packaged using a plastic material film (3) having a direction of tearing (D) therein, a plurality of said articles (2) being disposed side-by-side in at least one superposed layer, the film being folded over along a winding direction around the articles, a continuous zone of weakening (A) to facilitate tearing the plastic material film (3) by a tongue (J) displaced therefrom for pulling in a direction transverse to the direction of the continuous zone of weakening, the zone of weakening being oriented transversely to the direction of tearing (D) and forming a band (6) which surrounds the pack, the zone of weakening (A) having a mechanical strength which is sufficiently high to bear traction stresses exerted on the film to retain the articles, but sufficiently low to permit opening of the film without a tool at any point whatsoever in the zone.

2. The pack of articles as claimed in claim 1, wherein the continuous zone of weakening (A) is perpendicular to the preferred direction of tearing (D).

3. The pack of articles as claimed in claim 2, wherein the continuous zone of weakening (A) comprises at least one line (7) of perforations (8).

4. The pack of articles as claimed in claim 3, wherein the continuous zone of weakening (A) comprises a central line (7) of perforations which is surrounded by two parallel lines (9, 10) of perforations spaced from the central line, and in which the distance (f) between two successive perforations is greater than the distance (g) between two successive perforations (8) of the central line.

5. The pack of articles as claimed in claim 4, wherein the distance (f) between two successive perforations (11*a*, 11*b* ) of the outer lines (9, 10) is equal to twice the distance (g) between two perforations of the central line.

6. The pack of articles as claimed in claim 5, wherein the perforations (11*a*, 11*b*) of the two outer lines (9, 10) are aligned with a perforation (8) of the central line along a direction orthogonal to the central line.

7. The pack of articles as claimed in claim 6, therefor and wherein the plastic material packaging film (3) is a two-layer film, the direction of tearing (D) of which is perpendicular to the direction of extrusion (E).

8. The pack of articles as claimed in claim 7, wherein the film (3) is an ionomeric coextruded polyethylene film, comprising therefor at least one layer of polyolefin and at least one layer of an ionic copolymer.

9. The pack of articles as claimed in claim 6, wherein the lines of perforations have a spacing of 5 to 30 mm, over a width of 30 to 100 mm.

10. The pack of articles as claimed in claim 9, wherein the zone of weakening (A) of the film covers over a succession of empty spaces (13) between the articles (2).

11. The pack of articles as claimed in claim 10, wherein the zone of weakening (A) of the film is provided halfway across the width of the film (3).

12. The pack of articles as claimed in claim 4, wherein the lines of perforations have a spacing of 5 to 30 mm, over a width of 30 to 100 mm.

13. The pack of articles as claimed in claim 1, wherein the continuous zone of weakening (A) comprises a central line (7) of perforations which is surrounded by two parallel lines (9, 10) of perforations spaced from the central line, and in which the distance (f) between two successive perforations is greater than the distance (g) between two successive perforations (8) of the central line.

14. The pack of articles as claimed in claim 1, wherein the plastic material packaging film (3) is a two-layer film, the preferred direction of tearing (D) of which is perpendicular to the direction of extrusion (E).

15. The pack of articles as claimed in claim 1, wherein the zone of weakening (A) of the film covers over a succession of empty spaces (13) between the articles (2).

16. The pack of articles as claimed in claim 1, wherein the zone of weakening (A) of the film is provided halfway across the width of the film (3).

17. A plastic material film tightly packing articles in a pack having a direction of tearing (D), which comprises a continuous zone of weakening (A), which zone is oriented transversely to the direction of tearing (D), wherein the zone of weakening (A) provides a tongue (J) for pulling in a direction transverse to the zone of weakening.

18. The plastic material film as claimed in claim 17, wherein the continuous zone of weakening (A) comprises three lines of perforations (7, 9, 10) comprising a central line (7) in which the perforations (8) have a smaller spacing and two outer lines (9, 10) which are parallel to the central line (7) and disposed on either side.

19. A process for preparing a plastic material film as claimed in claim 18, wherein the perforations (8, 11*a*, 11*b*) are formed in the course of the unwinding or of the winding of the film (3) before packaging along its entire length at the time of extrusion, rewinding, printing or on a tight packing machine for packing articles.

20. A process for preparing a plastic material film as claimed in claim 17, wherein the perforations (8, 11*a*, 11*b*) are formed in the course of the unwinding or of the winding of the film (3) before packaging along its entire length at the time of extrusion, rewinding, printing or on a tight packing machine for packing articles.

21. A package of articles comprising:

an array of abutting articles, a plastic film material wrapped around the articles in a selected direction of wrapping and having traction stresses therein oriented in the selected direction, a continuous zone of weakening extending in the selected direction of wrapping to provide selectable sites therewithin for rupturing the plastic film, and a zone of tearing in the plastic film extending externally of the zone of weakening at a location beginning at one of the sites selected for rupturing the plastic film to provide a tear strip in the plastic film for opening the package by pulling the tear strip transverse to the zone of weakening.

22. The package of claim 21, wherein the articles are selected one cans, canisters or bottles.

23. The package of claim 22, wherein there are spaces between the articles defined by gaps where the articles do not abut.

24. The package of claim 23, wherein the sites for rupturing the plastic film occur at spaces in the film between areas of the film abutting the articles.

25. The package of claim 23, wherein the zone of weakening is defined by a linear array of perforations.

26. The package of claim 21, wherein the zone of weakening is defined by a linear array of perforations.

27. The package of claim 26, wherein the plastic film material is heat shrunk around the articles and held thereagainst by traction stresses.

28. The package of claim 21, wherein the articles are one of cans, canisters or bottles stacked in a rectangular array with spaces therebetween defined by gaps where the articles do not abut; wherein the plastic film is heat shrunk around the articles and wherein the zone of tearing extends perpendicular to the zone of weakening.

29. The package of claim 28, wherein the zone of weakening is created by a linear array of perforations.

30. The package of claim 29, wherein the zone of weakening extends around the package over the tops and bottoms of the articles and wherein there are openings in the plastic film at opposite ends of the package.

31. The package of claim 30, wherein the openings are oval.

32. The package of claim 21, wherein the plastic film material comprises at least one layer of polyolefin and at least one layer of an ionic co-polymer.

33. The package of claim 32, wherein the plastic film material comprises an ionomeric coextruded polyethylene film.

* * * * *

UNITED STATES PATENT AND TRADEMARK OFFICE

CERTIFICATE OF CORRECTION

PATENT NO. : 6,105,776
DATED : August 22, 2000
INVENTOR(S) : Daniel Meilhon

It is certified that error appears in the above-identified patent and that said Letters Patent is hereby corrected as shown below:

Title page,
Please insert: -- [30] FR 97 09404 7/24/1997 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*